US009273371B2

(12) United States Patent
Murakami et al.

(10) Patent No.: US 9,273,371 B2
(45) Date of Patent: Mar. 1, 2016

(54) MANUFACTURING METHOD OF GRAIN-ORIENTED ELECTRICAL STEEL SHEET

(75) Inventors: Kenichi Murakami, Tokyo (JP); Chie Hama, Tokyo (JP); Kazumi Mizukami, Tokyo (JP); Yoshiyuki Ushigami, Tokyo (JP); Shuichi Nakamura, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/635,172

(22) PCT Filed: Mar. 15, 2011

(86) PCT No.: PCT/JP2011/056074
§ 371 (c)(1),
(2), (4) Date: Sep. 14, 2012

(87) PCT Pub. No.: WO2011/115120
PCT Pub. Date: Sep. 22, 2011

(65) Prior Publication Data

US 2013/0000786 A1 Jan. 3, 2013

(30) Foreign Application Priority Data

Mar. 17, 2010 (JP) ..... 2010-061298

(51) Int. Cl.
*C23C 8/02* (2006.01)
*C23C 8/26* (2006.01)
(Continued)

(52) U.S. Cl.
CPC ..... *C21D 8/1222* (2013.01); *C21D 3/04* (2013.01); *C21D 6/008* (2013.01); *C21D 8/12* (2013.01);
(Continued)

(58) Field of Classification Search
USPC ..... 148/208
See application file for complete search history.

(56) References Cited

U.S. PATENT DOCUMENTS 4,888,066 A * 12/1989 Yoshitomi et al. ..... 148/113
5,643,370 A * 7/1997 Huppi ..... 148/111
(Continued)

FOREIGN PATENT DOCUMENTS

JP 55-6412 A 1/1980
JP 3-122227 A 5/1991
(Continued)

OTHER PUBLICATIONS

ASM International, Materials Park, Ohio, Properties and Selection: Irons, Steels, and High Performance Alloys, "Sheet Formability of Steels", Mar. 1990, vol. 1, pp. 573-580.*
(Continued)

*Primary Examiner* — Jessee Roe
(74) *Attorney, Agent, or Firm* — Birch, Stewart, Kolasch & Birch, LLP

(57) ABSTRACT

A predetermined steel containing Te: 0.0005 mass % to 0.0050 mass % is heated to 1320° C. or lower to be subjected to hot rolling, and is subjected to annealing, cold rolling, decarburization annealing, and nitridation annealing, and thereby a decarburized nitrided steel sheet is obtained. Further, an annealing separating agent is applied on the surface of the decarburized nitrided steel sheet and finish annealing is performed, and thereby a glass coating film is formed. The N content of the decarburized nitrided steel sheet is set to 0.0150 mass % to 0.0250 mass % and the relationship of 2×[Te]+[N] ≤0.0300 mass % is set to be established. Note that [Te] represents the Te content and [N] represents the N content.

3 Claims, 1 Drawing Sheet

(51) Int. Cl.

| | |
|---|---|
| ***C21D 8/12*** | (2006.01) |
| ***C21D 3/04*** | (2006.01) |
| ***C21D 6/00*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |
| ***C22C 38/60*** | (2006.01) |
| ***H01F 1/18*** | (2006.01) |
| ***C23C 8/80*** | (2006.01) |
| *B21B 3/00* | (2006.01) |
| *B21B 3/02* | (2006.01) |

(52) U.S. Cl.

CPC ..... *C21D 8/1255* (2013.01); *C21D 8/1272* (2013.01); *C21D 8/1283* (2013.01); *C21D 9/46* (2013.01); *C22C 38/001* (2013.01); *C22C 38/008* (2013.01); *C22C 38/02* (2013.01); *C22C 38/04* (2013.01); *C22C 38/06* (2013.01); *C22C 38/34* (2013.01); *C22C 38/60* (2013.01); *C23C 8/02* (2013.01); *C23C 8/80* (2013.01); *H01F 1/18* (2013.01); *B21B 3/00* (2013.01); *B21B 3/02* (2013.01); *C21D 2201/05* (2013.01)

USPC ..... 148/208

(56) References Cited

U.S. PATENT DOCUMENTS

| | | | | |
|---|---|---|---|---|
| 5,833,768 | A * | 11/1998 | Kosuge et al. | 148/111 |
| 2010/0055481 | A1 * | 3/2010 | Kubo et al. | 428/471 |

FOREIGN PATENT DOCUMENTS

| | | | |
|---|---|---|---|
| JP | 5-78743 | A | 3/1993 |
| JP | 6-184640 | A | 7/1994 |
| JP | 6-207220 | A | 7/1994 |
| JP | 10-273727 | A | 10/1998 |
| JP | 2009-209428 | A | 9/2009 |
| JP | 2009-235574 | A | 10/2009 |
| WO | WO 2009/091127 | A2 | 7/2009 |

OTHER PUBLICATIONS

ASM International, Materials Park, Ohio, Heat Treating, "Gas Nitriding", Aug. 1991, vol. 4, pp. 387-409.*

International Search Report, issued in PCT/JP2011/056074, dated Jun. 21, 2011.

Forms PCT/IB/338, PCT/IB/373, and PCT/ISA/237, mailed Nov. 1, 2012, for International Application No. PCT/JP2011/056074.

Extended European Search Report for European Application No. 11756305.6, dated Apr. 24, 2014.

* cited by examiner

MANUFACTURING METHOD OF GRAIN-ORIENTED ELECTRICAL STEEL SHEET

TECHNICAL FIELD

The present invention relates to a manufacturing method of a grain-oriented electrical steel sheet having a good magnetic property and coating film in an industrial scale.

BACKGROUND ART

A grain-oriented electrical steel sheet is a steel sheet that contains Si and of which the orientation of crystal grains is highly integrated in the {110}<001> orientation, and is used as a material of a wound iron core and so on of a stationary induction apparatus such as a transformer. The control of the orientation of the crystal grains is performed by using an abnormal grain growth phenomenon called secondary recrystallization.

In recent years, there has been a growing tendency to save energy, so that as a method to achieve the above secondary recrystallization, the following manufacturing techniques have been established. In Patent Literature 1, there has been disclosed a low-temperature slab heating method in which based on heating a slab at a temperature of 1280° C. or lower, in a nitridation annealing step performed after cold rolling, fine dispersed precipitates such as AlN, (Al.Si)N being inhibitors are precipitated.

Further, there has been known a method of containing an auxiliary element that strengthens the function of inhibitors in a grain-oriented electrical steel sheet, in order to improve a magnetic property of a product. A method of utilizing Te as the element as above has been disclosed in Patent Literatures 2 to 5.

However, when Te is contained in the grain-oriented electrical steel sheet, the magnetic property of a product is improved, but there is caused a problem that a defect is caused on an appearance of a glass coating film existing on the surface of the grain-oriented electrical steel sheet.

CITATION LIST

Patent Literature

Patent Literature 1: Japanese Laid-open Patent Publication No. 03-122227

Patent Literature 2: Japanese Laid-open Patent Publication No. 06-184640

Patent Literature 3: Japanese Laid-open Patent Publication No. 06-207220

Patent Literature 4: Japanese Laid-open Patent Publication No. 10-273727

Patent Literature 5: Japanese Laid-open Patent Publication No. 2009-235574

Patent Literature 6: Japanese Laid-open Patent Publication No. 05-78743

SUMMARY OF INVENTION

Technical Problem

Then, the present invention has an object to provide a manufacturing method of a grain-oriented electrical steel sheet in which a good magnetic property and a glass coating film having a good appearance are achieved.

Solution to Problem

The gist of the present invention to solve the above-described object is as follows.

(1) A manufacturing method of a grain-oriented electrical steel sheet includes:

heating a steel containing Si: 2.5 mass % to 4.0 mass %, C: 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, P: 0.01 mass % to 0.08 mass %, and Te: 0.0005 mass % to 0.0050 mass %, and a balance being composed of Fe and inevitable impurities to 1320° C. or lower and performing hot rolling to obtain a hot-rolled steel sheet;

performing annealing of the hot-rolled steel sheet to obtain an annealed steel sheet;

performing cold rolling of the annealed steel sheet to obtain a cold-rolled steel sheet;

performing decarburization annealing and nitridation annealing of the cold-rolled steel sheet to obtain a decarburized nitrided steel sheet; and applying an annealing separating agent on a surface of the decarburized nitrided steel sheet and performing finish annealing of the decarburized nitrided steel sheet to form a glass coating film, in which the N content of the decarburized nitrided steel sheet is set to 0.0150 mass % to 0.0250 mass % and the relationship of $2\times[Te]+[N]\leq 0.0300$ mass % is set to be established. Here, [Te] represents the Te content of the decarburized nitrided steel sheet, and [N] represents the N content of the decarburized nitrided steel sheet.

(2) The manufacturing method of the grain-oriented electrical steel sheet according to (1), in which a speed of increasing temperature in the decarburization annealing and the nitridation annealing is set to 50° C./s to 300° C./s.

(3) The manufacturing method of the grain-oriented electrical steel sheet according to (1) or (2), in which the steel further contains 0.01 mass % to 0.3 mass % of one type or a plurality of types selected from a group consisting of Sn, Sb, Cr, Ni, B, Mo, and Cu.

(4) The manufacturing method of the grain-oriented electrical steel sheet according to any one of (1) to (3) further includes: performing purification annealing of a steel sheet on which the finish annealing has been performed at a temperature of 1170° C. or higher for 15 hours or longer.

Advantageous Effects of Invention

According to the present invention, by containing a certain amount of Te in a steel and controlling the N content by nitridation annealing, it is possible to provide a grain-oriented electrical steel sheet in which a good magnetic property and a glass coating film having a good appearance are achieved.

DESCRIPTION OF EMBODIMENTS

Hereinafter, an embodiment of the present invention will be explained in detail.

In the case when a grain-oriented electrical steel sheet is manufactured by a low-temperature slab heating method, in order to strengthen the function of inhibitors, a nitriding treatment is performed continuously after decarburization annealing, or a nitriding treatment is performed simultaneously with decarburization annealing to thereby increase nitrogen in the steel sheet. Further, in order to further strengthen inhibitors to obtain a good magnetic property, Te is sometimes contained. However, when Te is contained too much, a good glass coating film cannot be formed.

Thus, the present inventors thought that the object may be solved by controlling the Te content and the N content in the steel sheet when nitriding, and thus conducted various experiments repeatedly in a manner to change the Te content and the N content. As a result, it was found that by controlling the Te content and the N content after nitridation annealing, a good magnetic property and formation of a glass coating film having a good appearance can be achieved.

That is, the present inventors prepared steel ingots in which various percentages of Te are contained in components used for manufacturing the grain-oriented electrical steel sheet by a low-temperature slab heating method. Then, each of the steel ingots was heated at a temperature of 1320° C. or lower to be hot rolled, and then was cold rolled. Subsequently, decarburization annealing and nitridation annealing were performed in a manner to change a flow rate of ammonia diversely, and thereafter finish annealing was performed and grain-oriented electrical steel sheets were manufactured. Then, as for these grain-oriented electrical steel sheets having different conditions, their magnetic flux density B8 and an appearance of a glass coating film formed at the time of finish annealing were evaluated.

As a result, it was found that when it is controlled that Te is contained in the steel ingot in a range of not less than 0.0005 mass % nor more than 0.0050 mass %, and the N content is set to be not less than 0.0150 mass % nor more than 0.0250 mass % on the occasion of nitridation annealing in which N is contained in a steel sheet to be performed sequentially to or simultaneously with the decarburization annealing, and further the relationship of "$2\times[Te]+[N]\leq 0.0300$ mass %" is established, a good magnetic property and formation of a glass coating film having a good appearance can be achieved. Here, [Te] represents the Te content after the nitridation annealing, and [N] represents the N content after the nitridation annealing.

Figure 1:
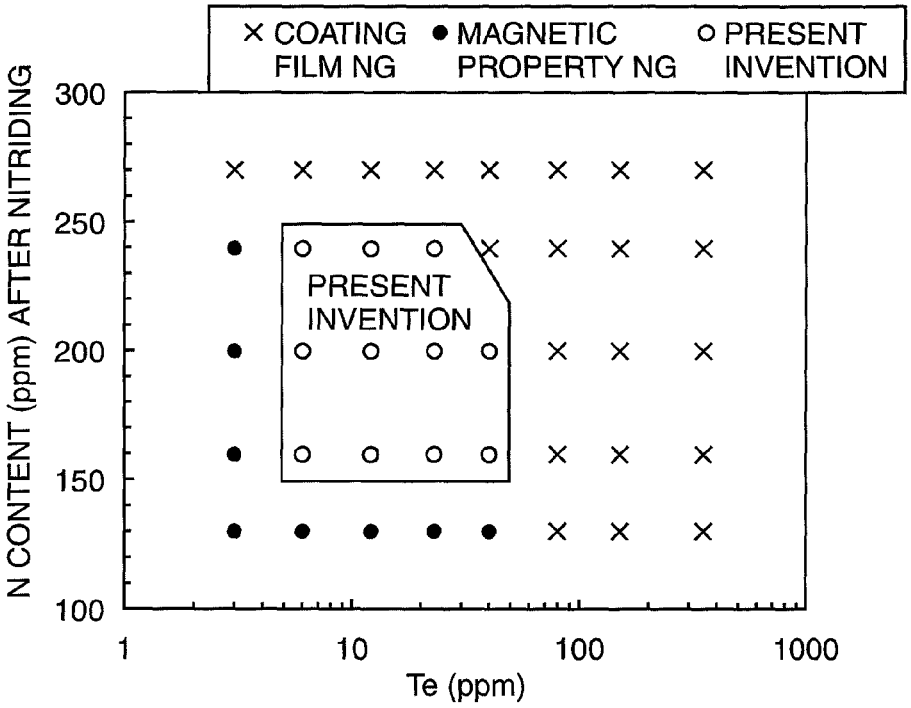
FIG. 1 is a view showing results of evaluation of an appearance of a glass coating film and a magnetic property in a relationship between a N content after nitriding and a Te content.

One example of the obtained results is shown in FIG. 1.

Details will be explained later in Example 1, but in FIG. 1, ○ mark indicates one in which the magnetic flux density and the glass coating film were both good because the average value of the magnetic flux density B8 was 1.93 T or more and the number of defects of the glass coating film was five or less. ● mark indicates one in which the magnetic flux density was not good because the average value of the magnetic flux density B8 was less than 1.93 T, but the glass coating film was good because the number of defects of the glass coating film was five or less. Further, X mark indicates one in which the glass coating film was not good because the number of defects of the glass coating film exceeded five.

Next, there will be explained a manufacturing method of a grain-oriented electrical steel sheet according to an embodiment of the present invention.

In this embodiment, first, casting of a molten steel for a grain-oriented electrical steel sheet with a predetermined composition is performed to manufacture a slab. A casting method is not limited in particular. The molten steel contains, for example, Si: 2.5 mass % to 4.0 mass %, C, 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, and P: 0.01 mass % to 0.08 mass %. The molten steel further contains Te: 0.0005 mass % to 0.0050 mass %. The balance of the molten steel is composed of Fe and inevitable impurities. Incidentally, in the inevitable impurities, there are also contained elements that form inhibitors in processes of manufacturing the grain-oriented electrical steel sheet and remain in the grain-oriented electrical steel sheet after purification by high-temperature annealing.

Here, limitation reasons of the numerical values of the composition of the above-described molten steel will be explained.

Si is an element quite effective for increasing electrical resistance of the grain-oriented electrical steel sheet to thereby decrease an eddy current loss constituting part of core loss. When the Si content is less than 2.5 mass %, it is not possible to sufficiently suppress the eddy current loss. On the other hand, when the Si content exceeds 4.0 mass %, workability deteriorates. Thus, the Si content is set to 2.5 mass % to 4.0 mass %.

Further, according to the Si content, the value of saturation magnetization Bs changes. The above saturation magnetization Bs becomes smaller as the Si content is increased. Thus, the reference value of the good magnetic flux density B8 also becomes smaller as the Si content is increased.

C is an element effective for controlling a structure obtained by primary recrystallization (primary recrystallization structure). When the C content is less than 0.02 mass %, this effect cannot be obtained sufficiently. On the other hand, when the C content exceeds 0.10 mass %, time required for the decarburization annealing becomes longer and an emission amount of $CO_2$ increases. Incidentally, unless the decarburization annealing is performed sufficiently, the grain-oriented electrical steel sheet having the good magnetic property is not easily obtained. Thus, the C content is set to 0.02 mass % to 0.10 mass %. Further, in recent years, there is a request to decrease an emission amount of $CO_2$, so that the time for the decarburization annealing is desirably shortened. From the above point, the C content is preferably set to 0.06 mass % or less.

Mn increases specific resistance of the grain-oriented electrical steel sheet to decrease the core loss. Mn also exhibits a function of preventing occurrence of a crack during the hot rolling. When the Mn content is less than 0.05 mass %, these effects cannot be obtained sufficiently. On the other hand, when the Mn content exceeds 0.20 mass %, the magnetic flux density of the grain-oriented electrical steel sheet decreases. Thus, the Mn content is set to 0.05 mass % to 0.20 mass %.

Acid-soluble Al is an important element that forms AlN functioning as an inhibitor. When the content of acid-soluble Al is less than 0.020 mass %, it is not possible to form a sufficient amount of AlN and thus the inhibitor strength becomes insufficient. On the other hand, when the content of acid-soluble Al exceeds 0.040 mass %, AlN coarsens, and thereby the inhibitor strength decreases. Thus, the content of acid-soluble Al is set to 0.020 mass % to 0.040 mass %.

N is an important element that reacts with acid-soluble Al to form AlN. As will be described later, a nitriding treatment is performed after the cold rolling, so that a large amount of N is not required to be contained in the steel for the grain-oriented electrical steel sheet, but when the N content is set to be less than 0.002 mass %, there is sometimes a case that a large load is required at the time of manufacturing the steel. On the other hand, when the N content exceeds 0.012 mass %, a hole called blister is caused in the steel sheet at the time of cold rolling. Thus, the N content is set to 0.002 mass % to 0.012 mass %. Further, the N content is preferably 0.010 mass % or less in order to further decrease blisters.

S is an important element that reacts with Mn to thereby form MnS precipitates. The MnS precipitates mainly affect the primary recrystallization to exhibit a function of suppressing locational change in grain growth of the primary recrystallization ascribable to the hot rolling. When the S content is less than 0.001 mass %, this effect cannot be obtained sufficiently. On the other hand, when the S content exceeds 0.010 mass %, the magnetic property is likely to deteriorate. Thus, the S content is set to 0.001 mass % to 0.010 mass %. The S content is preferably 0.009 mass % or less in order to further improve the magnetic property.

P increases specific resistance of the grain-oriented electrical steel sheet to decrease the core loss. When the P content is less than 0.01 mass %, this effect cannot be obtained sufficiently. On the other hand, when the P content exceeds 0.08 mass %, the cold rolling sometimes becomes difficult to be performed. Thus, the P content is set to 0.01 mass % to 0.08 mass %.

Te is an element of strengthening inhibitors. When the Te content is less than 0.0005 mass %, Te cannot improve the magnetic property sufficiently as the element of strengthening inhibitors. Further, when the Te content exceeds 0.0050 mass %, the magnetic property and the glass coating film are deteriorated. Thus, the Te content is set to be not less than 0.0005 mass % nor more than 0.0050 mass %. Further, the Te content is preferably 0.0010 mass % or more, and is preferably 0.0035 mass % or less.

In this embodiment, the above elements are contained as the components of the molten steel, but about 0.01 mass % to 0.3 mass % of Sn, Sb, Cr, Ni, B, Mo, and Cu may also be further contained.

In this embodiment, the slab is manufactured from the molten steel having such a composition, and then the slab is heated. As for the temperature of the above heating, 1320° C. or lower is sufficient because the nitridation annealing is performed later and thus the precipitates are not required to be solid-dissolved completely at this time. Further, the temperature of the above heating is preferably set to 1250° C. or lower in terms of saving energy.

Next, the hot rolling of the slab is performed, and thereby a hot-rolled steel sheet is obtained. The thickness of the hot-rolled steel sheet is not limited in particular, and is set to 1.8 mm to 3.5 mm, for example.

Thereafter, annealing of the hot-rolled steel sheet is performed, and thereby an annealed steel sheet is obtained. The condition of the annealing is not limited in particular, and the annealing is performed at a temperature of 750° C. to 1200° C. for 30 seconds to 10 minutes, for example. The magnetic property is improved by the above annealing.

Subsequently, the cold rolling of the annealed steel sheet is performed, and thereby a cold-rolled steel sheet is obtained. The cold rolling may be performed only one time, or may also be performed a plurality of times while intermediate annealing being performed therebetween. The intermediate annealing is preferably performed at a temperature of 750° C. to 1200° C. for 30 seconds to 10 minutes, for example.

Incidentally, when the cold rolling is performed without the intermediate annealing as described above being performed, there is sometimes a case that a uniform property is not easily obtained. Further, when the cold rolling is performed a plurality of times while the intermediate annealing being performed therebetween, a uniform property is easily obtained, but the magnetic flux density sometimes decreases. Thus, the number of times of the cold rolling and whether or not the intermediate annealing is performed are preferably determined according to the property and cost required for the grain-oriented electrical steel sheet to be obtained finally.

Further, even in any case, the reduction ratio of the final cold rolling is preferably set to 80% to 95%.

Next, the decarburization annealing of the cold-rolled steel sheet is performed in order to eliminate C contained in the cold-rolled steel sheet to then cause the primary recrystallization. Further, in order to increase the N content in the steel sheet, the nitridation annealing is performed simultaneously with the decarburization annealing, and thereby a decarburized nitrided steel sheet is obtained, or the nitridation annealing is performed after the decarburization annealing, and thereby a decarburized nitrided steel sheet is obtained. In the above case, the nitridation annealing is preferably performed sequentially to the decarburization annealing.

In the case of decarburization and nitridation annealing in which the decarburization annealing and the nitridation annealing are performed simultaneously, in an atmosphere in which a gas having nitriding capability such as ammonia is further contained in a moist atmosphere containing hydrogen, nitrogen, and water vapor, the decarburization and nitridation annealing is performed. The decarburization and the nitridation are performed simultaneously in the above atmosphere, and thereby a steel sheet structure and composition suitable for secondary recrystallization are made. The decarburization and nitridation annealing on this occasion is preferably performed at a temperature of 800° C. to 950° C.

Further, in the case when the decarburization annealing and the nitridation annealing are performed in series, the decarburization annealing is first performed in a moist atmosphere containing hydrogen, nitrogen, and water vapor. Thereafter, the nitridation annealing is performed under an atmosphere containing hydrogen, nitrogen, and water vapor, and further a gas having nitriding capability such as ammonia. At this time, the decarburization annealing is preferably performed at a temperature of 800° C. to 950° C., and the nitridation annealing thereafter is preferably performed at a temperature of 700° C. to 850° C.

Further, in this embodiment, in the above-described decarburization annealing, or decarburization and nitridation annealing, a heating speed to increase temperature is preferably controlled to 50° C./s to 300° C./s in a temperature zone of 500° C. to 800° C. When the heating speed to increase temperature is less than 50° C./s, there is sometimes a case that the effect of improving the magnetic flux density cannot be obtained sufficiently, and also in the case when the heating speed to increase temperature exceeds 300° C./s, there is sometimes a case that the effect is decreased. Further, the heating speed to increase temperature is more preferably 70° C./s or more, and is more preferably 200° C./s or less. Further, the heating speed to increase temperature is still more preferably 80° C./s or more, and is still more preferably 150° C./s or less.

Further, in this embodiment, it is important to set the N content of the decarburized nitrided steel sheet after the nitridation annealing to 0.0150 mass % to 0.0250 mass %. When the N content is less than 0.0150 mass %, the secondary recrystallization in the finish annealing becomes unstable to cause the deterioration of the magnetic property. Incidentally, when the N content is increased, the secondary recrystallization is stabilized to obtain the good magnetic property, but when the N content exceeds 0.0250 mass %, conversely, the magnetic property deteriorates and the appearance of the glass coating film deteriorates. The N content is preferably 0.0180 mass % or more, and is preferably 0.0230 mass % or less.

Further, as the content of N and Te contained in the grain-oriented electrical steel sheet is increased, the appearance of the glass coating film is deteriorated. Thus, it is important that the N content and the Te content satisfy the range of $2\times[Te]+[N]\leq 0.0300$ mass %. The more preferable range of the above range is $2\times[Te]+[N]\leq 0.0280$ mass %. Here, [Te] represents the Te content of the decarburized nitrided steel sheet, and [N] represents the N content of the decarburized nitrided steel sheet.

Next, an annealing separating agent having MgO as its main component in a water slurry form is applied on the surface of the decarburized nitrided steel sheet, and the decarburized nitrided steel sheet is wound up in a coil shape. Then, the batch-type finish annealing is performed on the coil-shaped decarburized nitrided steel sheet, and thereby a coil-shaped finish-annealed steel sheet is obtained. By the finish annealing, the secondary recrystallization is caused, and further the glass coating film is formed on the surface of the finish-annealed steel sheet.

Thereafter, purification annealing for eliminating impurities is preferably performed at a temperature of 1170° C. or higher for 15 hours or longer. The reason why the purification annealing is performed at a temperature of 1170° C. or higher for 15 hours or longer is because if the temperature is lower than the above-described temperature and the time is shorter than the above-described time, there is sometimes a case that the purification becomes insufficient and thereby Te remains internally in the steel sheet and the magnetic property deteriorates.

Then, a purification-annealed steel sheet has a coating solution having phosphate and colloidal silica as its main component, for example, applied thereon and is baked, and thereby a product of the grain-oriented electrical steel sheet with an insulating coating film adhering thereto is obtained.

By manufacturing the grain-oriented electrical steel sheet under the conditions explained above, it becomes possible to manufacture the grain-oriented electrical steel sheet in which the good magnetic property and the glass coating film having the good appearance are achieved.

EXAMPLE

Next, experiments conducted by the present inventors will be explained. Conditions and so on in these experiments are examples employed for confirming the applicability and effects of the present invention, and the present invention is not limited to these examples.

Example 1

Eight types of steel ingots in total each containing Si: 3.2 mass %, C, 0.06 mass %, Mn: 0.09 mass %, Al: 0.028 mass %, N: 0.008 mass %, and S: 0.006 mass %, and further Te in a manner that the amount of Te differs within the range of 0.0003 mass % to 0.0350 mass % as shown in FIG. 1, and a balance being composed of Fe and inevitable impurities were manufactured in a vacuum melting furnace. Then, annealing of the steel ingots was performed at 1150° C. for 1 hour, and thereafter hot rolling was performed, and thereby hot-rolled steel sheets each having a thickness of 2.3 mm were obtained.

Subsequently, annealing of the hot-rolled steel sheets was performed at 1100° C. for 120 seconds, and thereby annealed steel sheets were obtained. Next, pickling of the annealed steel sheets was performed, and thereafter cold rolling was performed, and thereby cold-rolled steel sheets each having a thickness of 0.23 mm were obtained.

Subsequently, steel sheets for annealing were cut out of the cold-rolled steel sheets, and in a gas atmosphere containing water vapor, hydrogen, and nitrogen, decarburization annealing of the cold-rolled steel sheets was performed at 850° C. for 120 seconds, and in a gas atmosphere obtained by further containing ammonia in the above atmosphere, nitridation annealing was performed at 800° C. for 40 seconds, and thereby decarburized nitrided steel sheets were obtained. The speed of increasing temperature of the decarburization annealing at this time was 105° C./s. Further, the N contents in nitrided annealed steel sheets were made to differ within the range of 0.0130 mass % to 0.0260 mass % by changing the flow rate of ammonia as shown in FIG. 1. Thereby, 40 types of the decarburized nitrided steel sheets in total were obtained.

Thereafter, an annealing separating agent having MgO as its main component in a water slurry form was applied on each of the surfaces of the decarburized nitrided steel sheets. Then, finish annealing was performed at 1200° C. for 20 hours, and thereby finish-annealed steel sheets each having a glass coating film formed thereon were obtained. Subsequently, the finish-annealed steel sheets were water washed, and thereafter were each sheared into a single-sheet magnetic measurement size having a width of 60 mm and a length of 300 mm. Next, a coating film solution having aluminum phosphate and colloidal silica as its main component was applied to be baked, and thereby an insulating coating film was formed. As above, samples of the grain-oriented electrical steel sheet were obtained.

Subsequently, the magnetic flux density B8 of each of the grain-oriented electrical steel sheets was measured. The magnetic flux density B8 is the magnetic flux density generated in the grain-oriented electrical steel sheet when at 50 Hz, a magnetic field of 800 A/m is applied to the grain-oriented electrical steel sheet. Note that in the experiment, the evaluation was performed in each sample by the average value of the magnetic flux density B8 obtained when the five sheets being measured. Further, as for the evaluation of the appearance of the glass coating film, the number of blisters per 100 $mm^2$ of the single sheet was evaluated as the number of defects of the glass coating film.

FIG. 1 shows the relationship between the Te content and the N content after the nitriding that affect the evaluation of the appearance of the glass coating film and the magnetic property. In FIG. 1, the vertical axis indicates the N content after the nitriding, and the horizontal axis indicates the Te content. In the judgment in FIG. 1, ○ mark indicates one in which the magnetic property and the glass coating film were both good because the average value of the magnetic flux density B8 was 1.93 T or more and the number of defects of the glass coating film was five or less. Further, ● mark indicates one in which the magnetic property was not good because the average value of the magnetic flux density B8 was less than 1.93 T, but the glass coating film was good because the number of defects of the glass coating film was five or less. Further, X mark indicates one in which the magnetic property and the glass coating film were both not good because the average value of the magnetic flux density B8 was less than 1.93 T and the number of defects of the glass coating film exceeded five.

As shown in FIG. 1, in the case when the Te content is not less than 0.0005 mass % nor more than 0.0050 mass %, and the N content is not less than 0.0150 mass % nor more than 0.0250 mass %, and further the relationship of "$2\times[Te]+[N]\leq 0.0300$ mass %" is established, the magnetic property and the glass coating film are both good.

From the above, the Te content and the N content after the nitriding satisfy the above-described conditions, and thereby it is possible to manufacture the grain-oriented electrical steel sheet in which the good magnetic property of a product and the good coating film appearance are achieved.

Example 2

In a vacuum melting furnace, six types of steel ingots in total each containing Si: 3.3 mass %, C, 0.07 mass %, Mn: 0.10 mass %, Al: 0.030 mass %, N: 0.007 mass %, S: 0.007 mass %, and Sn: 0.05 mass % and further Te having the amount shown in Table 1, and a balance being composed of Fe and inevitable impurities were manufactured in a vacuum melting furnace. Further, a steel ingot not containing Te but having the same composition of the other elements other than Te was also manufactured similarly. Next, annealing of the steel ingots was performed at 1200° C. for 1 hour, and thereafter hot rolling was performed, and thereby hot-rolled steel sheets each having a thickness of 2.6 mm were obtained.

Subsequently, annealing of the hot-rolled steel sheets was performed at 1100° C. for 100 seconds, and thereby annealed steel sheets were obtained. Next, pickling of the annealed steel sheets was performed, and thereafter cold rolling of the annealed steel sheets was performed, and thereby cold-rolled steel sheets each having a thickness of 0.23 mm were obtained.

Subsequently, steel sheets for annealing were cut out of the cold-rolled steel sheets, and in a gas atmosphere containing water vapor, hydrogen, nitrogen, and ammonia, decarburization and nitridation annealing of the cold-rolled steel sheets was performed at 840° C. for 110 seconds, and thereby decarburized nitrided steel sheets were obtained. The speed of increasing temperature of the decarburization and nitridation annealing at this time was 100° C./s. Further, the N content in each of the decarburized nitrided steel sheets was 0.021 mass %.

Thereafter, an annealing separating agent having MgO as its main component in a water slurry form was applied on each of the surfaces of the decarburized nitrided steel sheets. Then, finish annealing was performed at 1200° C. for 20 hours, and thereby finish-annealed steel sheets each having a glass coating film formed thereon were obtained. Subsequently, the finish-annealed steel sheets were water washed, and thereafter were each sheared into a single-sheet magnetic measurement size having a width of 60 mm and a length of 300 mm. Next, a coating film solution having aluminum phosphate and colloidal silica as its main component was applied on each of the surfaces of the finish-annealed steel sheets to be baked, and thereby an insulating coating film was formed. As above, samples of the grain-oriented electrical steel sheet were obtained.

Subsequently, the magnetic flux density B8 of each of the grain-oriented electrical steel sheets was measured. The magnetic flux density B8 is the magnetic flux density generated in the grain-oriented electrical steel sheet when at 50 Hz, a magnetic field of 800 A/m is applied to the grain-oriented electrical steel sheet. Note that in the experiment, the evaluation was performed in each sample by the average value of the magnetic flux density B8 obtained when the five sheets being measured. Further, as for the evaluation of the appearance of the glass coating film, the number of blisters per 100 $mm^2$ of the single sheet was evaluated as the number of defects of the glass coating film.

In Table 1, the relationship between the Te content, the magnetic flux density, and the evaluation of the appearance of the glass coating film is shown. The judgment of the evaluation of the appearance of the glass coating film in Table 1 was set according to the number of defects of the glass coating film with ◎ mark indicating no defects, ○ mark indicating 1 to 5 pieces, and X mark indicating 6 pieces or more. Further, Si is contained more in this example than in the first example by 0.1 mass %, and thus the reference of the good magnetic flux density B8 is set to 1.92 T.

TABLE 1

| SAMPLE | Te (%) | MAGNETIC FLUX DENSITY B8 (T) | COATING FILM EVALUATION | NOTE |
|---|---|---|---|---|
| 1 | NOT ADDED | 1.905 | ◎ | COMPARATIVE EXAMPLE |
| 2 | 0.0008 | 1.921 | ◎ | PRESENT INVENTION |
| 3 | 0.0022 | 1.931 | ◎ | PRESENT INVENTION |
| 4 | 0.0039 | 1.938 | ○ | PRESENT INVENTION |
| 5 | 0.0048 | 1.936 | X | COMPARATIVE EXAMPLE |
| 6 | 0.0090 | 1.925 | X | COMPARATIVE EXAMPLE |
| 7 | 0.0142 | 1.882 | X | COMPARATIVE EXAMPLE |

As shown in Table 1, in the samples 2 to 5, the Te content falls within the range of 0.0005 mass % to 0.0050 mass %. In the samples 2 to 4 among the samples 2 to 5, the magnetic property and the glass coating film were both good because of the magnetic flux density being 1.92 T or more and the evaluation of the appearance of the glass coating film being ◎ or ○. Further, the sample that obtained the good result in particular was the sample 3 with the Te content falling within the range of 0.0015 mass % to 0.0035 mass %. On the other hand, in the sample 5, the evaluation of the appearance of the glass coating film was X because the Te content fell within the range of 0.0005 mass % to 0.0050 mass % but the condition of "$2\times[Te]+[N]\leq 0.0300$ mass %" was not satisfied.

Figure 2:
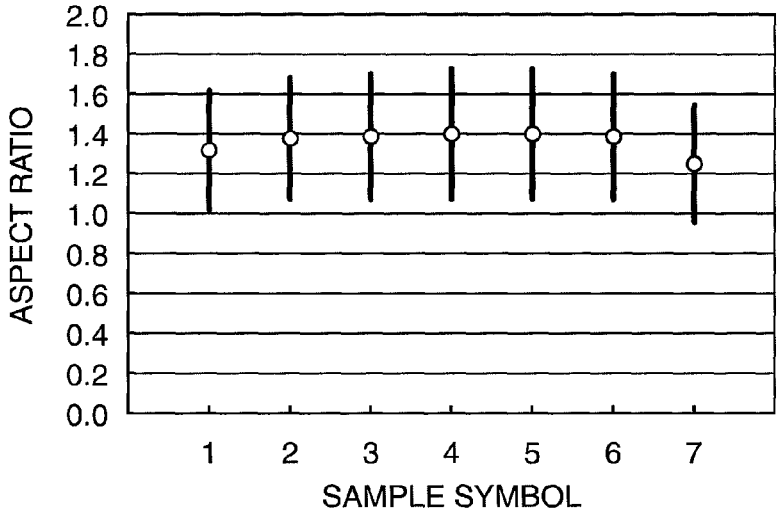
FIG. 2 is a view showing distribution of an aspect ratio in a secondary recrystallized grain.

Further, results of which an aspect ratio of 20 pieces of secondary recrystallized grains in each of the samples was measured are shown in FIG. 2. Note that in FIG. 2, ○ mark indicates the average value of the aspect ratio and the black line indicates an error bar. Further, the aspect ratio is defined to be the ratio of the length, of the secondary recrystallized grain, in the rolling direction to the length, of the secondary recrystallized grain, in the direction perpendicular to the rolling direction. As shown in FIG. 2, the aspect ratios slightly differ according to the Te content, but do not differ very much under the condition of the decarburization and nitridation annealing as is in this example, and an absolute value of the aspect ratio also does not exceed two.

Example 3

Steel ingots each containing Si: 3.1 mass %, C, 0.06 mass %, Mn: 0.10 mass %, Al: 0.031 mass %, N: 0.008 mass %, S: 0.007 mass %, Sn: 0.06 mass %, Cr: 0.1 mass %, and Te: 0.0023 mass %, and a balance being composed of Fe and inevitable impurities were manufactured in a vacuum melting furnace. Next, annealing of the steel ingots was performed at 1100° C. for 1 hour, and thereafter hot rolling was performed, and thereby hot-rolled steel sheets each having a thickness of 2.3 mm were obtained.

Subsequently, annealing of the hot-rolled steel sheets was performed at 1120° C. for 11 seconds, and thereby annealed steel sheets were obtained. Next, pickling of the annealed steel sheets was performed, and thereafter cold rolling of the annealed steel sheets was performed, and thereby cold-rolled steel sheets each having a thickness of 0.23 mm were obtained.

Subsequently, steel sheets for annealing were cut out of the cold-rolled steel sheets, and in a gas atmosphere containing water vapor, hydrogen, and nitrogen, decarburization annealing of the cold-rolled steel sheets was performed at 860° C. for 100 seconds, and in a gas atmosphere obtained by further containing ammonia in the above atmosphere, nitridation annealing was performed at 770° C. for 30 seconds, and thereby decarburized nitrided steel sheets were obtained. Note that the speed of increasing temperature of the decarburization annealing at this time was 100° C./s. Further, the N contents in nitrided annealed steel sheets were made to differ within the range of 0.0132 mass % to 0.0320 mass % by changing the flow rate of ammonia as shown in Table 2. Thereby, six types of the decarburized nitrided steel sheets in total were obtained.

Thereafter, an annealing separating agent having MgO as its main component in a water slurry form was applied on each of the surfaces of the decarburized nitrided steel sheets. Next, finish annealing was performed at 1200° C. for 20 hours, and thereby finish-annealed steel sheets each having a glass coating film formed thereon were obtained. Subsequently, the finish-annealed steel sheets were water washed, and thereafter were each sheared into a single-sheet magnetic measurement size having a width of 60 mm and a length of 300 mm. Next, a coating film solution having aluminum phosphate and colloidal silica as its main component was applied on each of the surfaces of the finish-annealed steel sheets to be baked, and thereby an insulating coating film was formed. As above, samples of the grain-oriented electrical steel sheet were obtained.

Subsequently, the magnetic flux density B8 of each of the grain-oriented electrical steel sheets was measured. The magnetic flux density B8 is the magnetic flux density generated in the grain-oriented electrical steel sheet when at 50 Hz, a magnetic field of 800 A/m is applied to the grain-oriented electrical steel sheet. Note that in the experiment, the evaluation was performed in each sample by the average value of the magnetic flux density B8 obtained when the five sheets being measured. Further, as for the evaluation of the appearance of the glass coating film, the number of blisters per 100 $mm^2$ of the single sheet was evaluated as the number of defects of the glass coating film.

Results of the magnetic flux density B8 of the manufactured grain-oriented electrical steel sheet and the evaluation of the appearance of the glass coating film are shown in Table 2. Note that the criterion for judging the evaluation of the appearance of the glass coating film is the same as that in Table 1. Further, Si is less in this example than in the first example by 0.1 mass %, but the reference of the good magnetic flux density B8 is set to 1.93 T.

TABLE 2

| SAMPLE | N (%) | MAGNETIC FLUX DENSITY B8 (T) | COATING FILM EVALUATION | NOTE |
|---|---|---|---|---|
| 11 | 0.0132 | 1.910 | ◎ | COMPARATIVE EXAMPLE |
| 12 | 0.0151 | 1.937 | ◎ | PRESENT INVENTION |
| 13 | 0.0209 | 1.942 | ◎ | PRESENT INVENTION |
| 14 | 0.0244 | 1.938 | ○ | PRESENT INVENTION |
| 15 | 0.0280 | 1.928 | X | COMPARATIVE EXAMPLE |
| 16 | 0.0320 | 1.902 | X | COMPARATIVE EXAMPLE |

As shown in Table 2, in the samples 12 to 14, the N content falls within the range of 0.0150 mass % to 0.0250 mass %, and the relationship of "2×[Te]+[N]≤0.0300 mass %" is established. In the above samples 12 to 14, the magnetic property and the glass coating film were both good because of the magnetic flux density being 1.93 T or more and the evaluation of the appearance of the glass coating film being ◎ or ○. The sample that obtained the good result in particular was the sample 13 with the N content falling within the range of 0.0180 mass % to 0.0230 mass %. Incidentally, in the sample 15 and the sample 16, the glass coating film was not good because the N content exceeded 0.0150 mass % to 0.0250 mass %.

Example 4

Steel ingots each containing Si: 3.4 mass %, C, 0.07 mass %, Mn: 0.09 mass %, Al: 0.029 mass %, N: 0.007 mass %, S: 0.005 mass %, P: 0.025 mass %, Sn: 0.06 mass %, and Te: 0.0026 mass %, and a balance being composed of Fe and inevitable impurities were manufactured in a vacuum melting furnace. Next, annealing of the steel ingots was performed at 1120° C. for 1 hour, and thereafter hot rolling was performed, and thereby hot-rolled steel sheets each having a thickness of 2.3 mm were obtained.

Subsequently, annealing of the hot-rolled steel sheets was performed at 1100° C. for 100 seconds, and thereby annealed steel sheets were obtained. Next, pickling of the annealed steel sheets was performed, and thereafter cold rolling was performed, and thereby cold-rolled steel sheets each having a thickness of 0.23 mm were obtained.

Subsequently, steel sheets for annealing were cut out of the cold-rolled steel sheets, and in a gas atmosphere containing water vapor, hydrogen, nitrogen, and ammonia, decarburization and nitridation annealing of the steel sheets was performed at 850° C. for 120 seconds, and thereby decarburized nitrided steel sheets were obtained. In the decarburization and nitridation annealing, the speed of increasing temperature was changed in six ways as shown in Table 3, and thereby six types of the decarburized nitrided steel sheets in total were obtained. Note that the N content of each of the decarburized nitrided steel sheets was 0.020 mass %.

Thereafter, an annealing separating agent having MgO as its main component in a water slurry form was applied on each of the surfaces of the decarburized nitrided steel sheets. Then, finish annealing was performed at 1200° C. for 20 hours, and thereby finish-annealed steel sheets each having a glass coating film formed thereon were obtained. Subsequently, the finish-annealed steel sheets were water washed, and thereafter were each sheared into a single-sheet magnetic measurement size having a width of 60 mm and a length of 300 mm. Next, a coating film solution having aluminum phosphate and colloidal silica as its main component was applied on each of the surfaces of the finish-annealed steel sheets to be baked, and thereby an insulating coating film was formed. As above, samples of the grain-oriented electrical steel sheet were obtained.

Subsequently, the magnetic flux density B8 of each of the grain-oriented electrical steel sheets was measured. The magnetic flux density B8 is the magnetic flux density generated in the grain-oriented electrical steel sheet when at 50 Hz, a magnetic field of 800 A/m is applied to the grain-oriented electrical steel sheet. Note that in the experiment, the evaluation was performed in each sample by the average value of the magnetic flux density B8 obtained when the five sheets being measured. Further, as for the evaluation of the appearance of the glass coating film, the number of blisters per 100 $mm^2$ of the single sheet was evaluated as the number of defects of the glass coating film.

Results of the magnetic flux density B8 of the manufactured grain-oriented electrical steel sheet and the evaluation of the appearance of the glass coating film are shown in Table 3. Note that the criterion for judging the evaluation of the appearance of the glass coating film is the same as that in Table 1. Further, Si is contained more in this example than in the first example by 0.2 mass %, and thus the reference of the good magnetic flux density B8 in particular is set to 1.91 T.

TABLE 3

| SAMPLE | SPEED OF INCREASING TEMPERATURE (° C./s) | MAGNETIC FLUX DENSITY B8 (T) | COATING FILM EVALUATION |
|---|---|---|---|
| 21 | 35 | 1.902 | ◎ |
| 22 | 55 | 1.914 | ◎ |
| 23 | 105 | 1.923 | ◎ |
| 24 | 170 | 1.921 | ◎ |
| 25 | 280 | 1.913 | ◎ |
| 26 | 350 | 1.907 | ◎ |

As shown in Table 3, in the samples 22 to 25 with the speed of increasing temperature being 50° C./s to 300° C./s, the magnetic property and the glass coating film were both good because of the magnetic flux density being 1.91 T or more and the evaluation of the appearance of the glass coating film being ◎. Further, the sample that obtained the good result in particular was the sample 23 and the sample 24 with the speed of increasing temperature falling within the range of 70° C./s to 200° C./s.

INDUSTRIAL APPLICABILITY

The present invention can respond to requests for energy saving and facility rationalization in recent years, and can meet an increase in demand for a high-quality grain-oriented electrical steel sheet associated with a global increase in amount of power generation.

The invention claimed is:

1. A manufacturing method of a grain-oriented electrical steel sheet comprising:

heating a steel containing Si: 2.5 mass % to 4.0 mass %, C: 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, and Te: 0.0005 mass % to 0.0050 mass %, and a balance being composed of Fe and inevitable impurities to 1320° C. or lower and performing hot rolling to obtain a hot-rolled steel sheet having a thickness of 1.8 mm to 3.5 mm;

performing annealing of the hot-rolled steel sheet at a temperature of 750° C. to 1200° C. for 30 seconds to 10 minutes to obtain an annealed steel sheet;

performing cold rolling of the annealed steel sheet at a reduction ratio of 80% to 95% to obtain a cold-rolled steel sheet;

performing decarburization annealing at a temperature of 800° C. to 950° C. and nitridation annealing of the cold-rolled steel sheet to obtain a decarburized nitrided steel sheet; and applying an annealing separating agent on a surface of the decarburized nitrided steel sheet and performing finish annealing of the decarburized nitrided steel sheet to form a glass coating film, performing purification annealing of a steel sheet on which the finish annealing has been performed at a temperature of 1170° C. or higher for 20 hours or longer, wherein the N content of the decarburized nitrided steel sheet is set to 0.0150 mass % to 0.0250 mass % and the relationship of $2\times[Te]+[N]\leq 0.0300$ mass % is set to be established, and

[Te] represents the Te content of the decarburized nitrided steel sheet, and [N] represents the N content of the decarburized nitrided steel sheet.

2. The manufacturing method of the grain-oriented electrical steel sheet according to claim 1, wherein the steel further contains P: 0.01 mass % to 0.08 mass %, and 0.01 mass % to 0.3 mass % of one type or a plurality of types selected from the group consisting of Sn, Sb, Cr, Ni, B, Mo, and Cu.

3. The manufacturing method of the grain-oriented electrical steel sheet according to claim 1, wherein a speed of increasing temperature in the decarburization annealing and the nitridation annealing is set to 50° C./s to 300° C./s.

* * * * *